US009188030B2

(12) United States Patent
Takahashi

(10) Patent No.: US 9,188,030 B2
(45) Date of Patent: Nov. 17, 2015

(54) INTERNAL COMBUSTION ENGINE WITH VARIABLE VALVE OPENING CHARACTERISTICS

(75) Inventor: Masayuki Takahashi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 100 days.

(21) Appl. No.: 13/569,186

(22) Filed: Aug. 8, 2012

(65) Prior Publication Data

US 2013/0055977 A1 Mar. 7, 2013

(30) Foreign Application Priority Data

Sep. 3, 2011 (JP) ..... 2011-192184

(51) Int. Cl.

| | |
|---|---|
| ***F01L 1/34*** | (2006.01) |
| ***F01L 13/00*** | (2006.01) |
| ***F01L 1/344*** | (2006.01) |
| *F01L 1/047* | (2006.01) |

(52) U.S. Cl.

CPC ..... *F01L 13/0057* (2013.01); *F01L 1/3442* (2013.01); *F01L 2001/0473* (2013.01); *F01L 2001/34466* (2013.01)

(58) Field of Classification Search

CPC ..... F01L 1/3442; F01L 13/0057; F01L 2001/34466; F01L 2001/0473

USPC ..... 123/90.15, 90.17, 90.6

See application file for complete search history.

(56) References Cited

U.S. PATENT DOCUMENTS

| | | | | |
|---|---|---|---|---|
| 5,125,372 | A * | 6/1992 | Gondek | 123/90.17 |
| 5,417,186 | A * | 5/1995 | Elrod et al. | 123/90.17 |
| 5,671,706 | A * | 9/1997 | Frost et al. | 123/90.17 |
| 5,862,783 | A * | 1/1999 | Lewis | 123/90.17 |
| 7,444,968 | B2 * | 11/2008 | Lancefield et al. | 123/90.17 |
| 2006/0207529 | A1 * | 9/2006 | Lawrence et al. | 123/90.6 |
| 2009/0228187 | A1 * | 9/2009 | Nakamura | 701/103 |
| 2009/0260589 | A1 * | 10/2009 | Ottersbach et al. | 123/90.15 |
| 2011/0168114 | A1 * | 7/2011 | Kobayashi et al. | 123/90.17 |

(Continued)

FOREIGN PATENT DOCUMENTS

| | | |
|---|---|---|
| JP | 2002-054410 | 2/2002 |
| JP | 2002-054410 A | 2/2002 |

(Continued)

OTHER PUBLICATIONS

Japanese Office Action for corresponding JP Application No. 2011-192184, Jul. 29, 2013.

*Primary Examiner* — Zelalem Eshete
(74) *Attorney, Agent, or Firm* — Mori & Ward, LLP

(57) ABSTRACT

An internal combustion engine with variable valve opening characteristics includes an outer camshaft, an inner camshaft, an urging device, a cam phase changing device, and a locking device. The outer camshaft includes a first cam. The inner camshaft includes a second cam. The cam phase changing device includes a first rotating member, a second rotating member, an advance-angle-side oil hydraulic chamber, and a retard-angle-side oil hydraulic chamber. A cam phase of the one of the outer camshaft and the inner camshaft is changed by switching between oil hydraulic circuits that communicate with the advance-angle-side oil hydraulic chamber and the retard-angle-side oil hydraulic chamber. The locking device is provided to connect another of the outer camshaft and the inner camshaft to the first rotating member with a predetermined cam phase.

16 Claims, 12 Drawing Sheets

(56) References Cited

U.S. PATENT DOCUMENTS

| | | | | |
|---|---|---|---|---|
| 2011/0303173 | A1* | 12/2011 | Dietel et al. | 123/90.31 |
| 2012/0260873 | A1* | 10/2012 | Dietel et al. | 123/90.15 |

FOREIGN PATENT DOCUMENTS

| | | | |
|---|---|---|---|
| JP | 2002-537508 | | 11/2002 |
| JP | 2009-264133 | A | 11/2009 |
| JP | 2010-530496 | | 9/2010 |
| JP | 2011-504558 | | 2/2011 |
| JP | 2011-117415 | | 6/2011 |
| JP | 2011-144746 | | 7/2011 |
| JP | 2011/149394 | | 8/2011 |
| WO | WO 99/36677 | | 7/1999 |
| WO | WO 2008/157076 | | 12/2008 |
| WO | WO 2009/005999 | | 1/2009 |
| WO | WO 2009067789 | A1 * | 6/2009 |

* cited by examiner

INTERNAL COMBUSTION ENGINE WITH VARIABLE VALVE OPENING CHARACTERISTICS

CROSS-REFERENCE TO RELATED APPLICATIONS

The present application claims priority under 35 U.S.C. $119 to Japanese Patent Application No. 2011-192184, filed Sep. 3, 2011, entitled "Internal combustion engine with variable valve opening characteristics." The contents of this application are incorporated herein by reference in their entirety.

BACKGROUND OF THE INVENTION

1. Field of the Invention

The present disclosure relates to an internal combustion engine with variable valve opening characteristics.

2. Discussion of the Background

An increasing number of four cycle gasoline engines (hereinafter simply referred to as an engine) with various variable valve timing mechanisms have been proposed in order to achieve improvement in output and fuel consumption, and a reduction in the amount of toxic exhaust gas component. A variable valve timing mechanism which switches between a low-speed cam and a high-speed cam has been used to date, however, in recent years, a variable valve timing mechanism which achieves considerably improved transient characteristics, throttle-less operation, and the like by continuously and variably controlling a cam phase and a valve lift individually is becoming mainstream technology.

A Variable Timing Control Device (hereinafter referred to as a VTC) used for variable control of the cam phase includes a hydraulic actuator (hereinafter referred to as a VTC actuator) which is mounted near one end of a camshaft in a cylinder head, and a hydraulic pressure control valve which controls the oil pressure (engine oil pressure) supplied to the VTC actuator. A configuration is adopted in which the VTC actuator has a rotor with a plurality of vanes, and a housing which houses a rotor in a relatively rotatable manner, and the rotor and the housing are rotated relative to each other by supplying hydraulic fluid (engine oil) as needed to an advance angle chamber and a retard angle chamber which are formed in the housing. The rotor is fixed to the camshaft, while a cam sprocket is formed integrally with the housing (see Japanese Unexamined Patent Application Publication No. 2009-264133).

On the other hand, the present applicant has proposed an opening angle variable valve device which includes an intake camshaft in a double structure composed of a fixed outer camshaft, and a movable inner camshaft so as to allow an intake opening angle (a period between valve opening and valve closing) to be variably controlled by setting different phases of the outer camshaft and the inner camshaft using a phase change unit (a hydraulic actuator similar to the VTC actuator). In the device, a fixed intake cam formed in the outer camshaft, and a movable intake cam formed in the inner camshaft have the same cam profile, and when the phases of the outer camshaft and the inner camshaft are the same, the device operates similarly to a normal inlet cam, whereas when the phases of the outer camshaft and the inner camshaft are shifted with respect to each other (the inner camshaft is rotated relative to the outer camshaft), the high part of the fixed intake cam and the high part of the movable intake cam are arranged continuously in the circumferential direction, and thus the intake opening angle is increased (see Japanese Unexamined Patent Application Publication No. 2002-54410).

SUMMARY OF THE INVENTION

According to one aspect of the present invention, an internal combustion engine with variable valve opening characteristics includes an outer camshaft, an inner camshaft, an urging device, a cam phase changing device, and a locking device. The outer camshaft includes a first cam provided on an outer circumference of the outer camshaft to open and close a valve. The inner camshaft is provided inside the outer camshaft to be rotatable relative to the outer camshaft and includes a second cam provided on the outer circumference of the outer camshaft to open and close the valve. The second cam is rotatable integrally with the inner camshaft, and is rotatable relative to the first cam. The urging device is provided between the outer camshaft and the inner camshaft to apply a relative rotational force to the outer camshaft and the inner camshaft. The cam phase changing device includes a first rotating member, a second rotating member, an advance-angle-side oil hydraulic chamber, and a retard-angle-side oil hydraulic chamber. The first rotating member is rotatable in synchronization with a crankshaft. The second rotating member is rotatable integrally with one of the outer camshaft and the inner camshaft and rotatably connected to the first rotating member. The advance-angle-side oil hydraulic chamber is provided between the first rotating member and the second rotating member. The retard-angle-side oil hydraulic chamber is provided between the first rotating member and the second rotating member. A cam phase of the one of the outer camshaft and the inner camshaft is changed by switching between oil hydraulic circuits that communicate with the advance-angle-side oil hydraulic chamber and the retard-angle-side oil hydraulic chamber. The locking device is provided to connect the other of the outer camshaft and the inner camshaft to the first rotating member with a predetermined cam phase.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
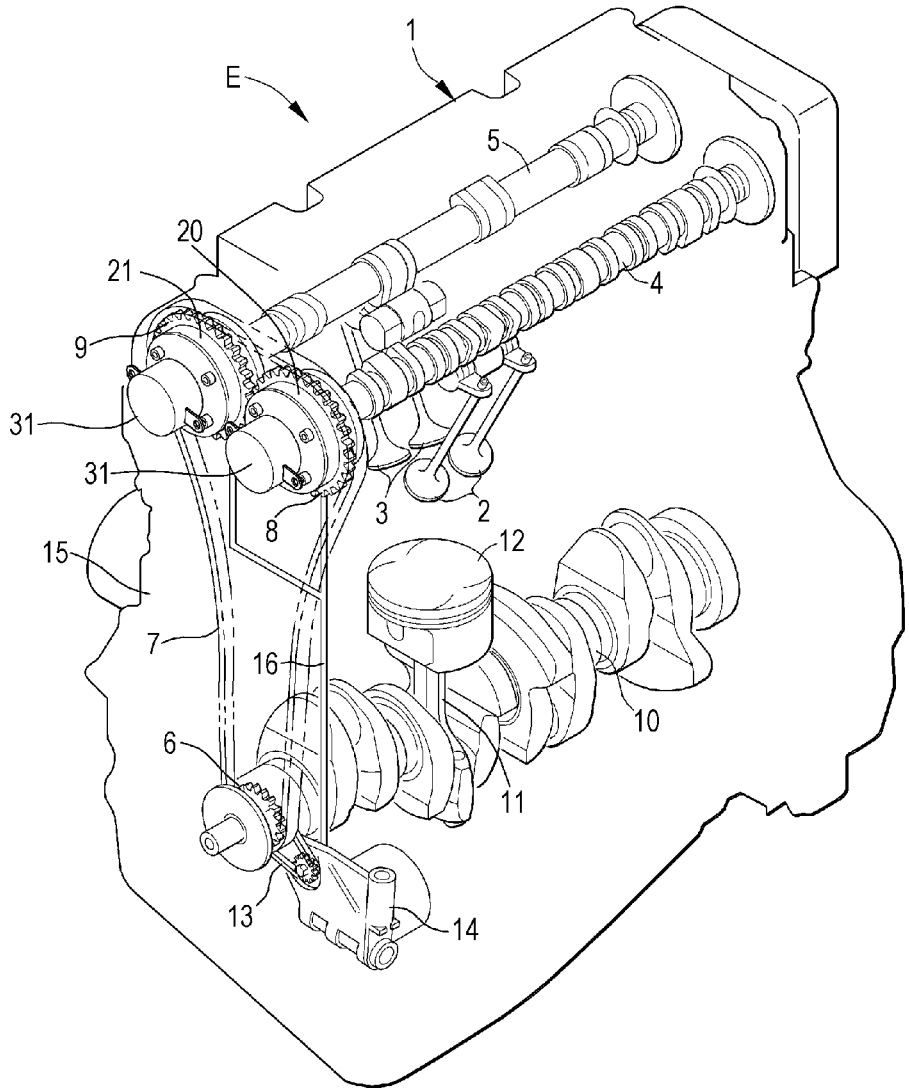
FIG. 1 is a perspective view of the main part of an engine for an automobile according to an embodiment.

The embodiments will now be described with reference to the accompanying drawings, wherein like reference numerals designate corresponding or identical elements throughout the various drawings.

Hereinafter, an embodiment of an internal combustion engine with variable valve opening characteristics according to the present disclosure will be described in detail with reference to the accompanying drawings.

Configuration of Embodiment

Overall Configuration

An engine (internal combustion engine with variable valve opening characteristics) E illustrated in FIG. 1 is a DOHC4 valve type in-line 4-cycle, 4-cylinder gasoline engine to be mounted on an automobile, and a cylinder head 1 includes intake valves 2 and exhaust valves 3 each for two cylinders, and an intake camshaft 4 and an exhaust camshaft 5 that drive the intake and exhaust valves 2 and 3, respectively. Both of the camshafts 4 and 5 are driven and rotated by a crankshaft 10 via a crank sprocket 6, a cam chain 7, an intake cam sprocket 8, and an exhaust cam sprocket 9 with a half rotational speed of the crankshaft 10. In addition, the crankshaft 10 is connected to a piston 12 via a connecting rod 11, and drives an oil pump (supply source of hydraulic fluid) 14 disposed diagonally below the crankshaft 10 via a chain 13. An intake-side VTC actuator 20 is mounted on the front end of the intake camshaft 4, and an exhaust-side VTC actuator 21 is mounted on the front end of the exhaust camshaft 5. In the cylinder head 1 and a cylinder block 15, there is formed an oil passage 16 which supplies hydraulic fluid (engine oil) from the oil pump 14 to both of the VTC actuators 20 and 21.

<Variable Valve Timing Mechanism>

Figure 2:
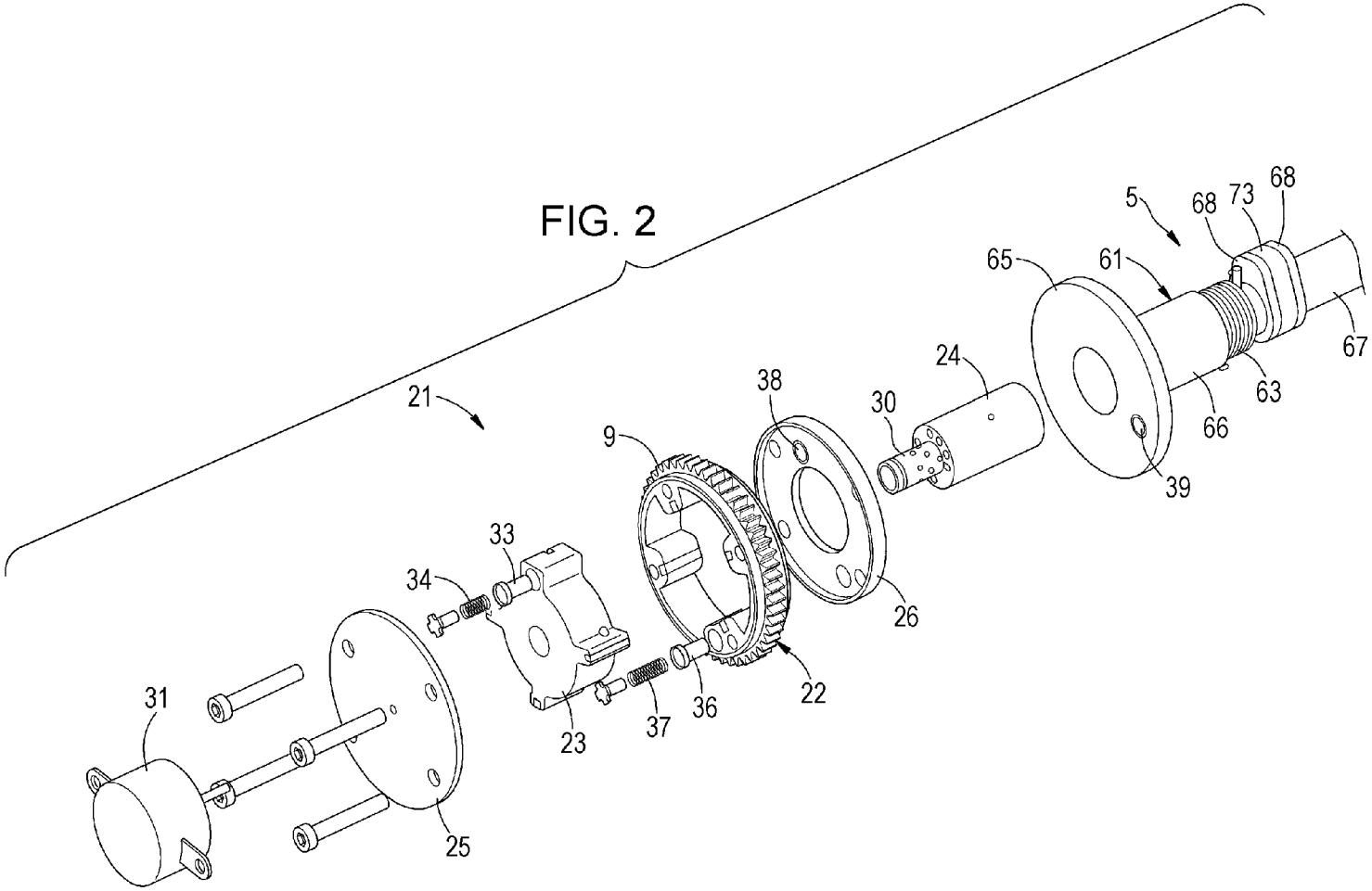
FIG. 2 is an exploded perspective view of a variable valve timing mechanism on the exhaust side according to the embodiment.

As illustrated in FIG. 2, the exhaust-side VTC actuator (hereinafter simply referred to as the VTC actuator) 21 includes components of: a housing (a first rotating member) 22, on the rim of which the exhaust cam sprocket 9 is formed; a rotor (a second rotating member) 23 which is rotatably held in the housing 22; a cylindrical rotor extension 24 which is fixed to and integrated with the axial center of the rotor 23 by press-fitting or the like; a front cover 25 which covers the front of the housing 22; a back plate 26 which covers the rear of the housing 22; an oil control valve (hereinafter referred to as an OCV) 30 which is held in the axial center of the rotor extension 24; a linear solenoid 31 which is controlled by an engine ECU (not shown) to drive the OCV 30; a first lock pin 33 which is held in the rotor 23 slidably in the axial direction; a first lock pin spring 34 which urges the first lock pin 33 toward the back plate 26; a second lock pin 36 which is held in the housing 22 slidably in the axial direction; and a second lock pin spring 37 which urges the second lock pin 36 toward the exhaust camshaft 5.

Figure 3:
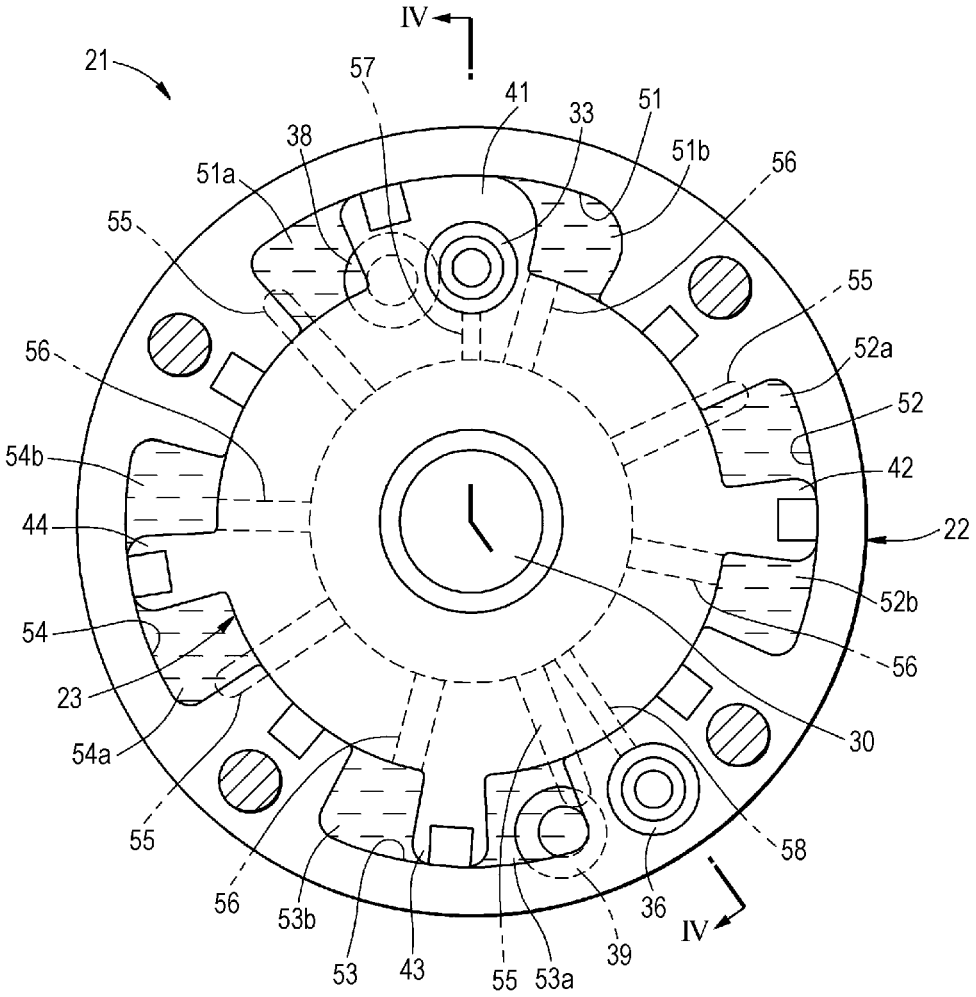
FIG. 3 is a front view of the variable valve timing mechanism on the exhaust side according to the embodiment.

As illustrated in FIG. 3, on the outer circumference of the rotor 23, there are vertically disposed first to fourth vanes 41 to 44. On the other hand, on the inner circumference of the housing 22, there are formed first to fourth vane chambers 51 to 54 which respectively house the vanes 41 to 44 in a relatively rotatable manner within a predetermined angle. In the housing 22 and the rotor 23, there are formed advance-angle-side oil passages 55 which supply hydraulic fluid from the OCV 30 to advance-angle-side oil chambers 51*a* to 54*a* of the first to fourth vane chambers 51 to 54, retard-angle-side oil passages 56 which supply hydraulic fluid from the OCV 30 to retard-angle-side oil chambers 51*b* to 54*b* of the first to fourth vane chambers 51 to 54, and a first lock release oil passage 57 which supplies hydraulic fluid from the oil passage 16 to the first lock pin 33. In addition, in the back plate 26, there is formed a second lock release oil passage 58 which supplies hydraulic fluid from a spool valve or the like (not shown) to the second lock pin 36.

Figure 4:
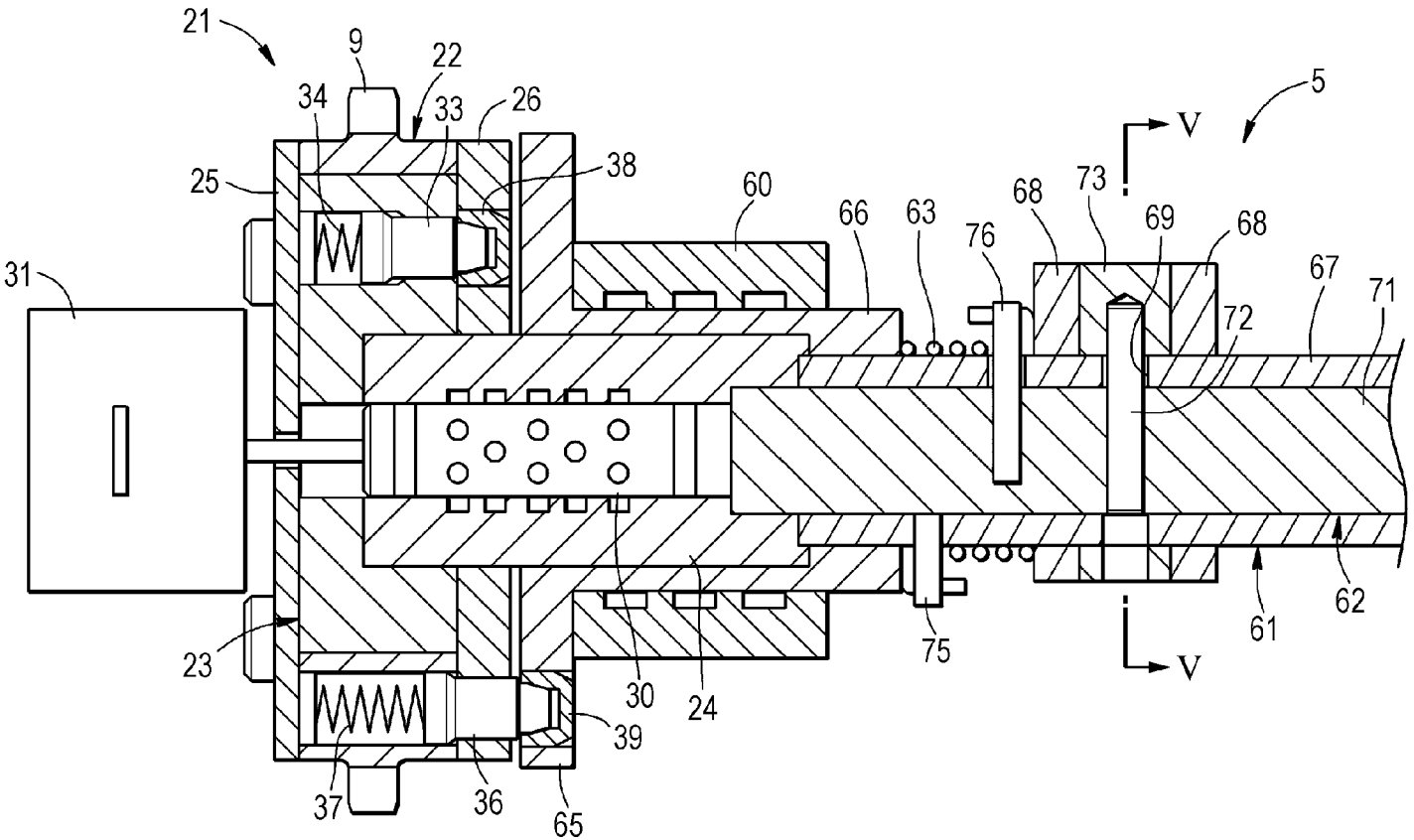
FIG. 4 is a cross-sectional view taken along a line IV-IV in FIG. 3.

As illustrated also in FIG. 4, the first lock pin 33 and the first lock pin spring 34 are housed in the first vane 41, and in the back plate 26, there is engaged a lock pin catch 38 into which the end of the first lock pin 33 is inserted at the maximum retard angle position of the rotor 23. The second lock pin 36 and the second lock pin spring 37 are housed between the second vane chamber 52 and the third vane chamber 53 in the housing 22, and in a flange 65 (described below) of the exhaust camshaft 5, there is engaged a lock pin catch 39 into which the end of the second lock pin 36 is inserted. FIG. 4 illustrates a state where the first and second lock pins 33 and 36 are inserted into the lock pin catches 38 and 39, respectively.

<Exhaust Camshaft>

Figure 5:
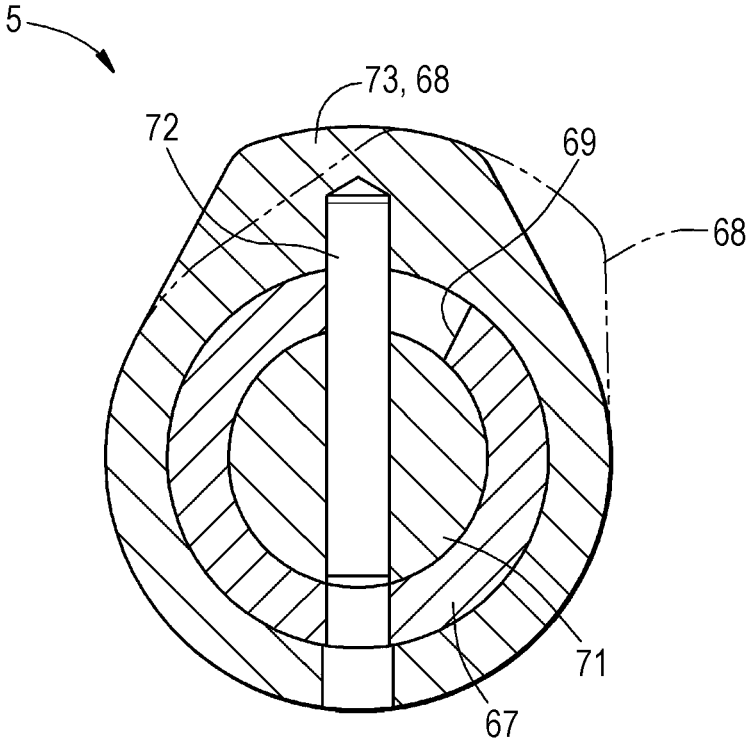
FIG. 5 is a cross-sectional view taken along a line V-V in FIG. 4.

As illustrated also in FIGS. 4 and 5, the exhaust camshaft 5 includes an outer camshaft 61 which is rotatably held in a cam holder 60; an inner camshaft 62 which is inwardly fitted rotatably relative to the outer camshaft 61; and a bias spring (torsion coil spring) 63 which constantly urges the outer camshaft 61 to the advance angle side with respect to the inner camshaft 62.

The outer camshaft 61 has the flange 65 which faces the back plate 26 of the VTC actuator 21; a base 66, the outer circumference of which is slidably in contact with the inner circumference of the cam holder 60; a hollow shaft body 67 which is press-fitted to and integrated with the base 66; and a pair of first cams 68 which are outwardly fitted to and integrated with the shaft body 67. The first cams 68 are firmly integrated with the shaft body 67 by press-fitting, shrink-fitting, or the like.

The inner camshaft 62 has a solid shaft body 71 which is press-fitted to and integrated with the rear end (the right end in FIG. 4) of the rotor extension 24; and a second cam 73 which is fixed to the shaft body 71 via a fixing pin 72. The second cam 73 is interposed between the first cams 68, and is loosely fitted to the outer circumference of the outer camshaft 61 in a relatively rotatable manner. In the shaft body 67 of the outer camshaft 61, there is formed a long hole 69 into which the fixing pin 72 is loosely fitted, and the fixing pin 72 (that is to say, the second cam 73) is rotatable relative to the first cam 68 within a predetermined angle range.

The bias spring 63 is hooked on latch pins 75, 76 at both ends, which are respectively press-fitted to the outer camshaft 61 and the inner camshaft 62, and constantly urges the outer camshaft 61 in the advance angle direction with respect to the inner camshaft 62. Under normal operating conditions, the first cams 68 are made to overlap and contact with the second cam 73 (the cam phases of first cams 68 are the same as the cam phase of the second cam 73) by an urging force of the bias spring 63, however, application of an external force to the first cams 68 causes them to rotate toward the retard angle side with respect to the second cam 73 as indicated by a chain double-dashed line in FIG. 5.

Effect of Embodiment

Hereinafter, the effect of the present embodiment will be described with reference to the schematic diagrams and graphs in FIGS. 6 to 12.

<At Start of Engine>

Figure 6:
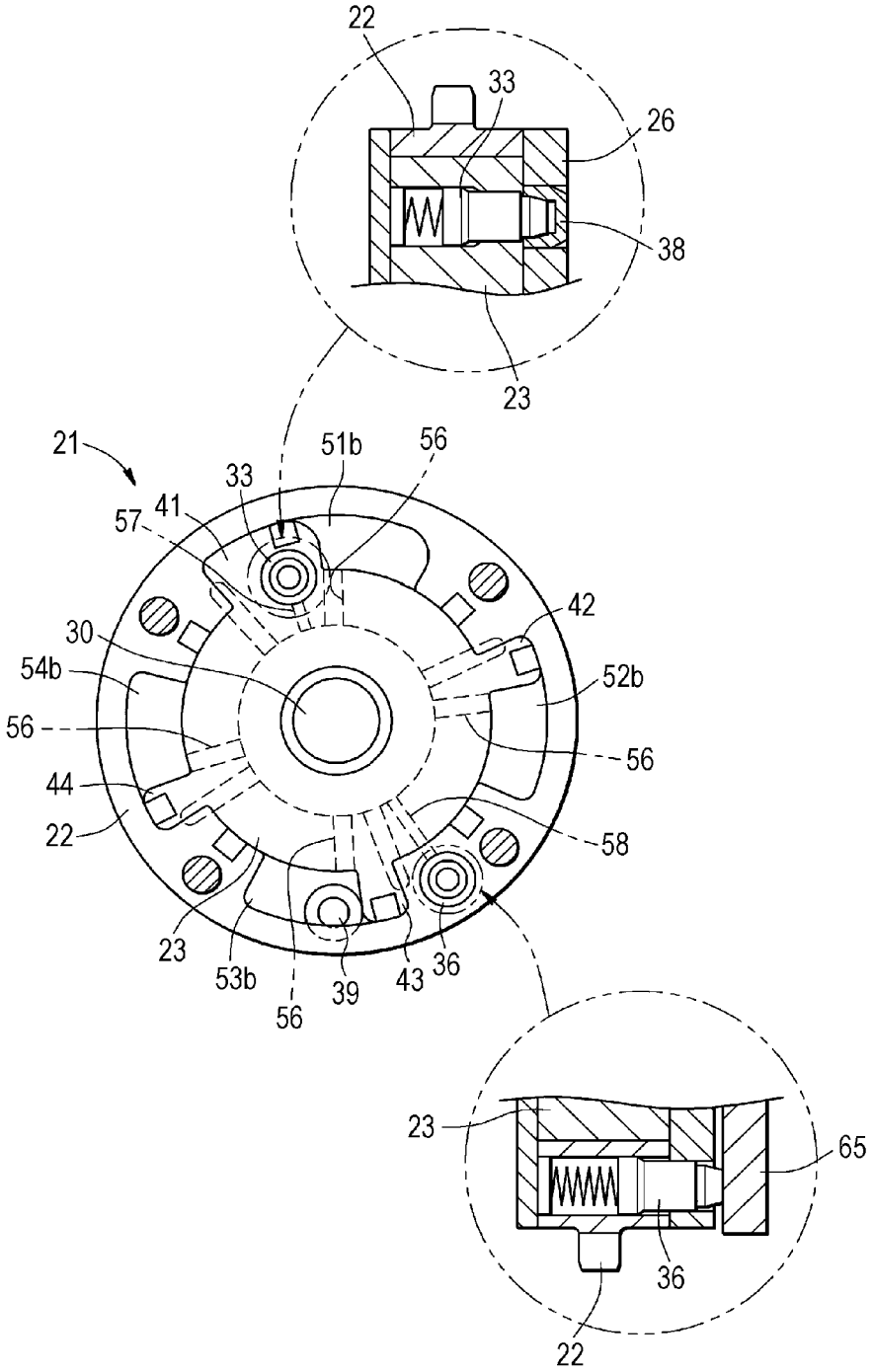
FIG. 6 is a schematic diagram illustrating an effect at a start time in the embodiment.
Figure 7:
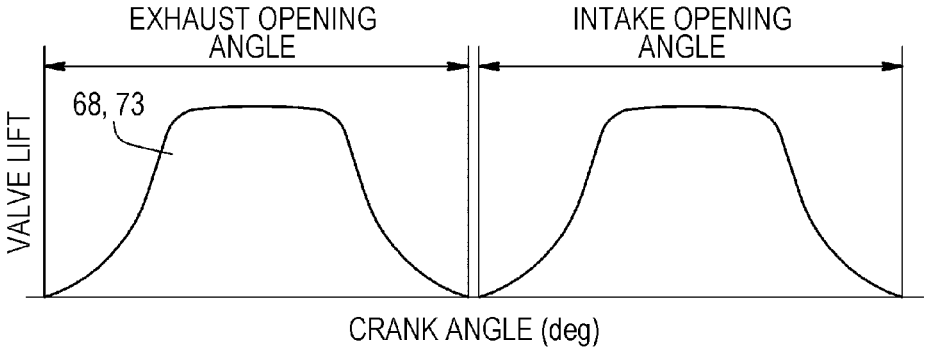
FIG. 7 is a graph illustrating the effect at a start time in the embodiment.

Because a sufficient amount of hydraulic fluid is not supplied to the VTC actuator 21 at the start of the engine E, in order to prevent the rotor 23 from accidentally rotating due to cam torque in the housing 22, the rotor 23 is held at the maximum advance angle position by the first lock pin 33 at the previous stop time as illustrated in FIG. 6. A hydraulic fluid from the second lock release oil passage 58 is not supplied to the second lock pin 36, which is pressed against the flange 65 of the exhaust camshaft 5 but is not inserted into the lock pin catch 39 because angle phases are different. Accordingly, the outer camshaft 61 rotates integrally with the inner camshaft 62 by an urging force of the bias spring 63. In the above state, the intake opening angle and the exhaust opening angle do not overlap with each other as illustrated in FIG. 7, and thus a reliable start can be achieved.

<Medium and Low Load Operation Regions>

Figure 8:
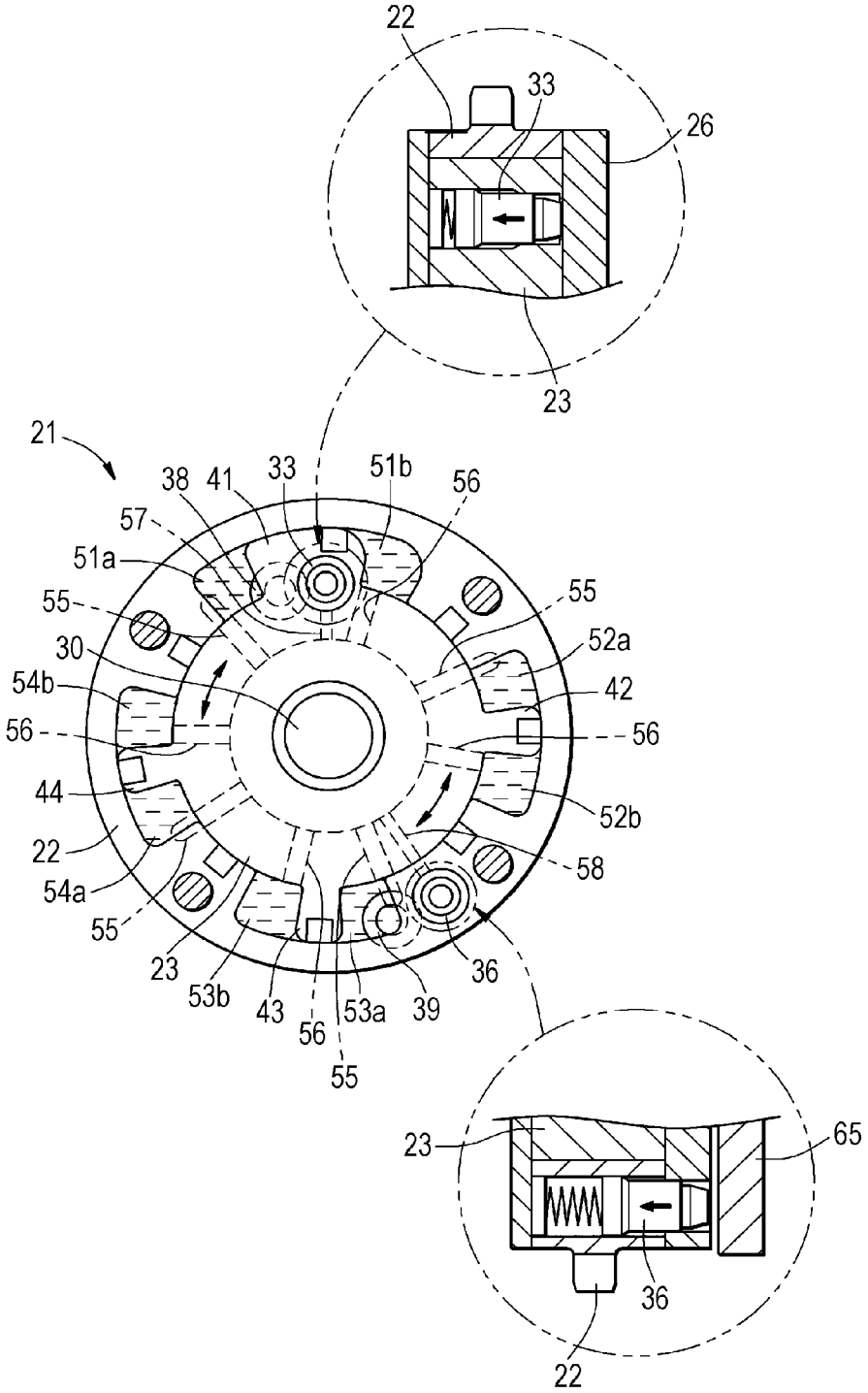
FIG. 8 is a schematic diagram illustrating an effect in a normal operation region in the embodiment.

When the engine E is started, hydraulic fluid from the oil passage 16 is supplied to the first lock pin 33 via the first lock release oil passage 57. On the other hand, the engine ECU supplies hydraulic fluid to the second lock pin 36 via the second lock release oil passage 58. Accordingly, connection between the rotor 23 and the housing 22 by the first lock pin 33 is cut, and thus the rotor 23 can be rotated toward the advance angle side or the retard angle side. Because hydraulic pressure which urges the second lock pin 36 to the release side is applied to the second lock pin 36, the second lock pin 36 and the lock pin catch 39 are not engaged with each other even when the second lock pin 36 passes over the lock pin catch 39. Accordingly, by the engine ECU supplying hydraulic fluid to the advance-angle-side oil chambers 51*a* to 54*a*, or the retard-angle-side oil chambers 51*b* to 54*b* via the advance-angle-side oil passages 55 and the retard-angle-side oil passages 56, the rotor 23 is rotated toward the advance angle side or the retard angle side as illustrated in FIG. 8, and the cam phase of the inner camshaft (the second cam 73) changes. In this case, the outer camshaft 61 also rotates integrally with the inner camshaft 62 by an urging force of the bias spring 63.

<High Load Operation Region>

Figure 9:
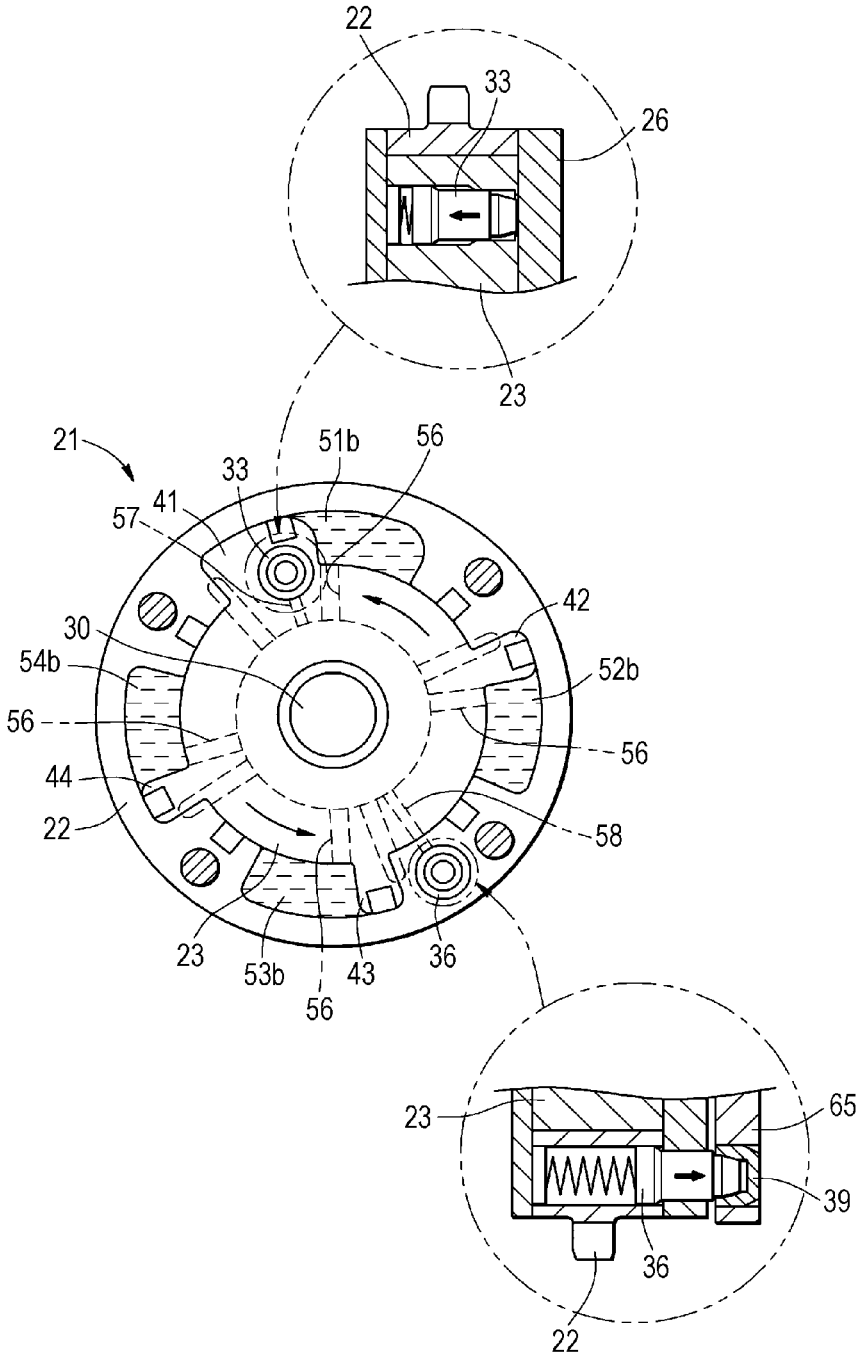
FIG. 9 is a schematic diagram illustrating an effect in a low-rotation high-load operation region in the embodiment.

When a driver steps on the accelerator pedal hard in a state where the engine E is in a low-rotation low-load operation state (that is to say, when the engine E is shifted to a low-rotation high-load operation region), as illustrated in FIG. 9, the engine ECU first supplies hydraulic fluid to the retard-angle-side oil chambers 51*b* to 54*b* via the retard-angle-side oil passages 56, while the hydraulic fluid of the second lock pin 36 is discharged from the second lock release oil passage 58. Accordingly, the rotor 23 is rotated toward the retard angle side so that the cam phases of the outer camshaft 61 (the first cam 68) and the inner camshaft 62 (the second cam 73) are set to the maximum retard angle, and the outer camshaft 61 (the flange 65 of the base 66) is fixed to the housing 22 by the second lock pin 36.

Figure 10:
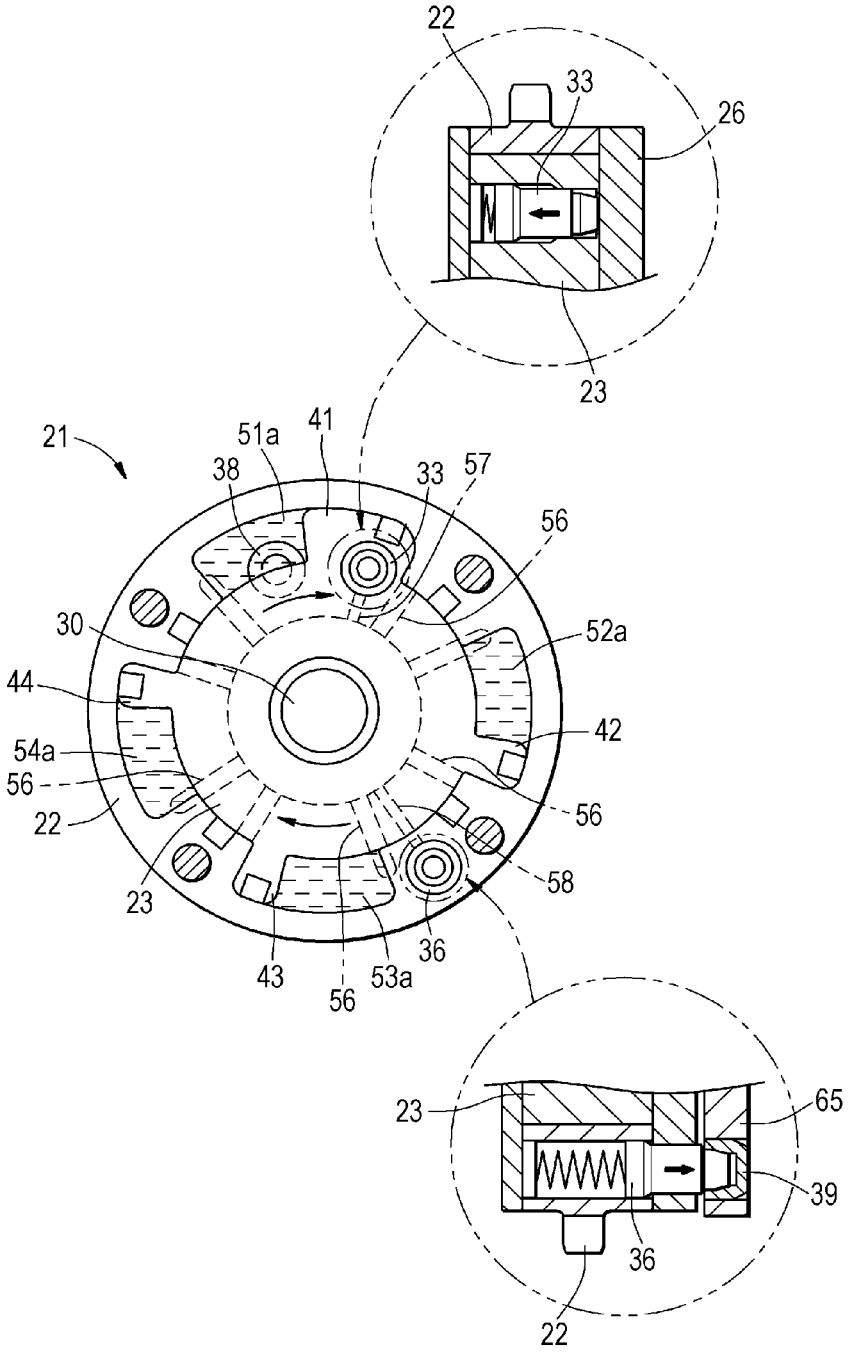
FIG. 10 is a schematic diagram illustrating an effect in a high-rotation high-load operation region in the embodiment.
Figure 11:
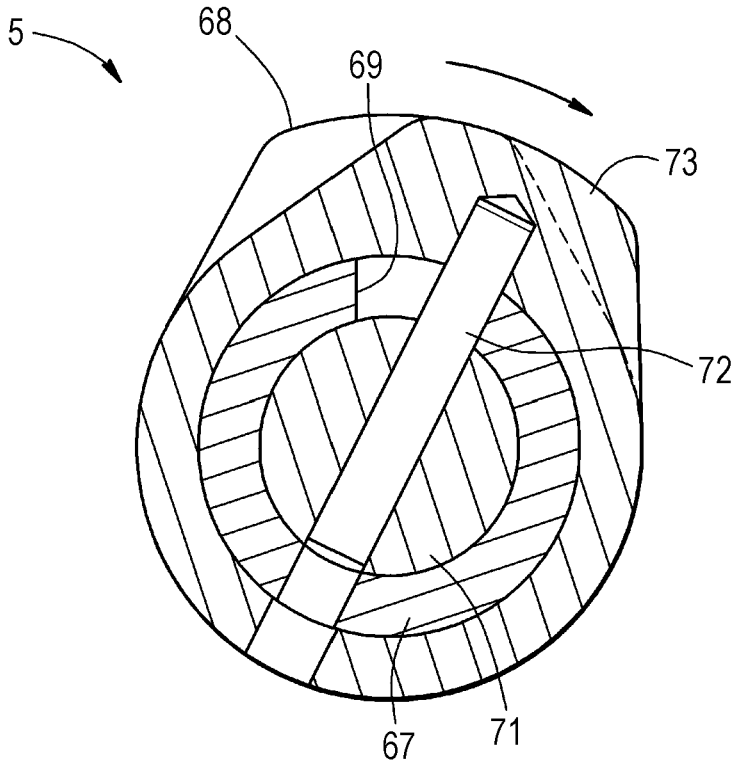
FIG. 11 is a schematic diagram illustrating another effect in a high-rotation high-load operation region in the embodiment.

When the rotation speed of the engine E is increased along with acceleration (that is to say, when the engine E is shifted to a high-rotation high-load operation region), the engine ECU supplies hydraulic fluid to the advance-angle-side oil chambers 51*a* to 54*a* via the advance-angle-side oil passages 55 with the hydraulic fluid of the second lock pin 36 being discharged from the second lock release oil passage 58. Accordingly, as illustrated in FIG. 10, the rotor 23 is rotated toward the advance angle side, and the cam phase of the inner camshaft 62 (the second cam 73) is advanced in angle (FIG. 10 indicates the maximum advance angle state), however, the outer camshaft 61 (the first cam 68) is fixed to the housing 22 by the second lock pin 36, and thus the cam phase remains at the maximum retard angle as illustrated in FIG. 11. Consequently, the high part of the first cam 68, and the high part of the second cam 73 are arranged continuously in the circumferential direction, and thus the exhaust opening angle is significantly increased.

Figure 12A:
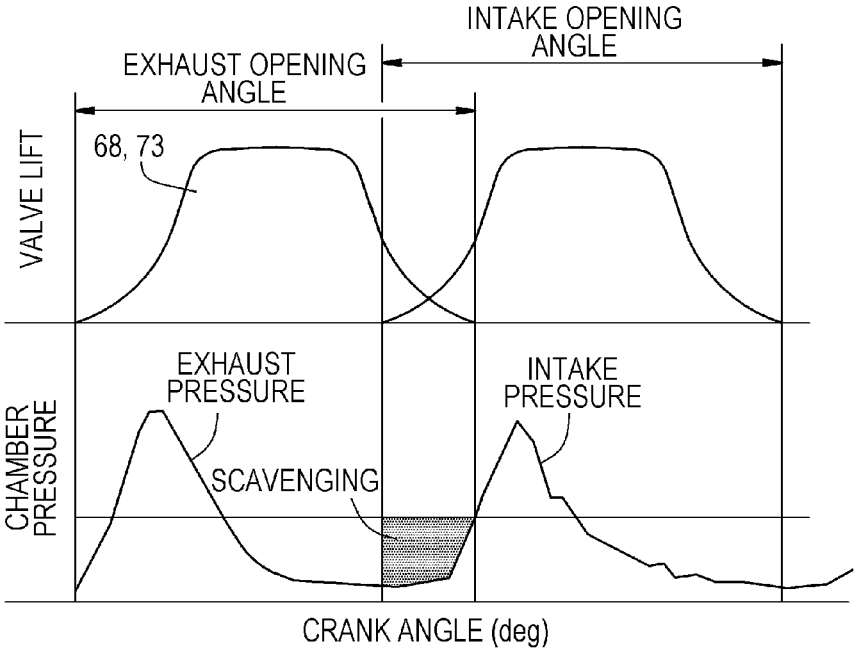
FIG. 12 is a graph illustrating an effect in a high load operation region in the embodiment.
Figure 12B:
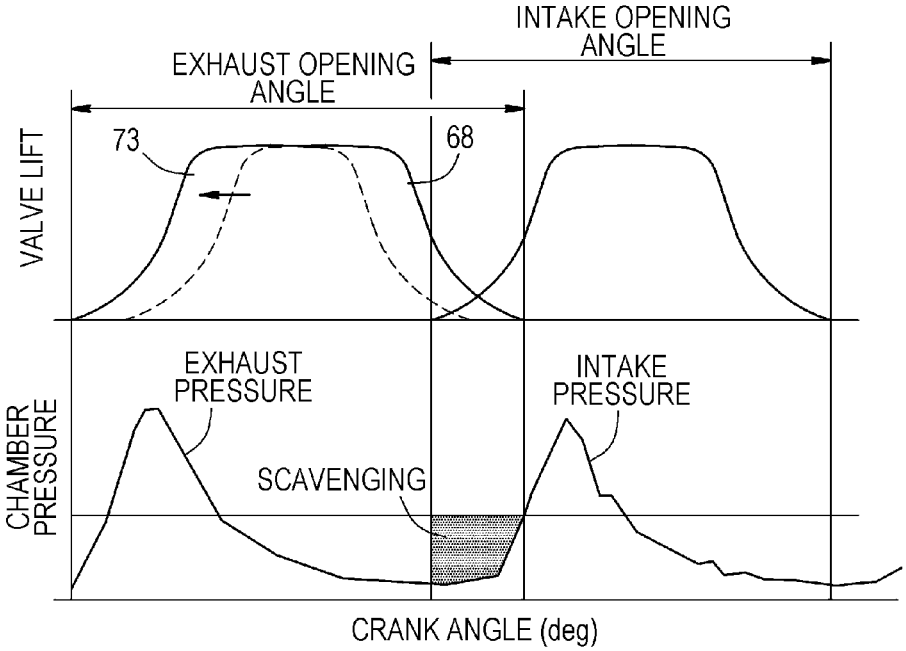

By adopting such a configuration in the present embodiment, as illustrated in FIG. 12A, in a low-rotation high-load operation region, the valve opening timing of the exhaust valve 3 with a small opening angle is delayed, and an overlap between exhaust and intake is ensured, thereby promoting scavenging of combustion chambers and reducing the influence of the exhaust pulsation from the cylinders adjacent to each other in firing order. Consequently, knocking is suppressed. In addition, as illustrated in FIG. 12B, in a high-rotation high-load operation region, even when the valve opening timing of the exhaust valve 3 is set earlier to improve exhaust efficiency, proper pumping overlap is ensured by widening the opening angle, and thus improvement and the like of the output can be achieved because of reliable scavenging.

Although further description of the embodiment is not provided, the aspects of the present disclosure are not limited to the above. For example, in the above-described embodiment, the present disclosure is applied to the valve timing mechanism on the exhaust side, however, the present disclosure may of course be applied to the valve timing mechanism on the intake side. In the above-described embodiment, the outer camshaft is fixed to the housing at the maximum retard angle position, however, the outer camshaft may be fixed at an arbitrary position between the maximum retard angle and the maximum advance angle, or may be fixed at a plurality of positions (for example, the opening angle is variably controlled at multiple levels by using a plurality of second lock pins and lock pin catches). In the above-described embodiment, the inner camshaft rotates integrally with the rotor, and the outer camshaft is fixed to the housing by the second lock pin. However, the outer camshaft may rotate integrally with the rotor, and the inner camshaft may be fixed to the housing by the second lock pin. In the above-described embodiment, press-fitting is used for the connection between the rotor and the rotor extension, and between the rotor extension and the inner camshaft. However, a serration connection, a spline connection, or the like may be used for the connection. In the above-described embodiment, the VTC actuator is driven by the OCV, and the second lock pin is driven by another spool valve. However, the VTC actuator and the second lock pin may be driven by a single hydraulic pressure control valve. In the above-described embodiment, when the second lock pin is engaged with a lock pin catch, hydraulic fluid is actively discharged from the second lock pin via the second lock release oil passage. However, supply of hydraulic fluid to the second lock pin may be stopped, and the hydraulic pressure applied to the second lock pin may be reduced by hydraulic fluid leaking from a space between the members (the housing, the second lock pin, and so on). Besides the above, the specific configuration of the engine in addition to the specific mechanism of the VTC actuator and the camshaft may be modified as needed within a scope which does not depart from the spirit of the present disclosure.

An internal combustion engine with variable valve opening characteristics according to a first aspect of the present embodiment controls a cam phase and an opening angle, the internal combustion engine with variable valve opening characteristics including: a cam phase change unit having an outer camshaft, on an outer circumference of which, a first cam used for opening and closing of a valve is formed and a second cam used for opening and closing of the valve is outwardly fitted rotatably relative to the first cam, an inner camshaft which is inwardly disposed rotatably relative to the outer camshaft, and rotates integrally with the second cam, an urging unit which is interposed between the outer camshaft and the inner camshaft and exerts a relative rotational force on the outer camshaft and the inner camshaft, a first rotating member which rotates in synchronization with a crankshaft, a second rotating member which rotates integrally with one of the outer camshaft and the inner camshaft and is connected rotatably relative to the first rotating member, wherein the cam phase of the one of the outer camshaft and the inner camshaft is changed by switching between oil hydraulic circuits that communicate with an advance-angle-side oil hydraulic chamber and a retard-angle-side oil hydraulic chamber which are formed between the first rotating member and the second rotating member; and a locking unit configured to connect the other of the outer camshaft and the inner camshaft to the first rotating member with a predetermined cam phase. Thus, when the other one of the both camshafts is rotated by the cam phase change unit, the cam phases of the both camshafts are shifted with respect to each other and the opening angle is increased. In the case where the outer camshaft and the inner camshaft are exhaust camshafts, reliable scavenging can be achieved in such a manner that in a predetermined operation region, the cam phases of the both camshafts are set to the maximum retard angle and the opening angle is reduced so as to be able to suppress knocking, while in another operation region, one of the both camshafts is advanced with the other camshaft being locked to the maximum retard angle, thereby increasing the exhaust opening angle.

According to a second aspect of the present embodiment, the outer camshaft and the inner camshaft are exhaust camshafts, and the urging unit exerts the relative rotational force in a direction such that a phase of the first cam matches a phase of the second cam, and the locking unit connects the other of the outer camshaft and the inner camshaft to the first rotating member at a maximum retard angle position.

Obviously, numerous modifications and variations of the present invention are possible in light of the above teachings. It is therefore to be understood that within the scope of the appended claims, the invention may be practiced otherwise than as specifically described herein.

What is claimed is:

1. An internal combustion engine with variable valve opening characteristics, comprising:

an outer camshaft including a first cam provided on an outer circumference of the outer camshaft to open and close a valve;

an inner camshaft provided inside the outer camshaft to be rotatable relative to the outer camshaft and including a second cam provided on the outer circumference of the outer camshaft to open and close the valve, the second cam being rotatable integrally with the inner camshaft and being rotatable relative to the first cam;

an urging device provided between the outer camshaft and the inner camshaft to apply a relative rotational force to the outer camshaft and the inner camshaft;

a cam phase changing device comprising:

a first rotating member rotatable in synchronization with a crankshaft;

a second rotating member rotatable integrally with one of the outer camshaft and the inner camshaft and rotatably connected to the first rotating member;

an advance-angle-side oil hydraulic chamber provided between the first rotating member and the second rotating member; and a retard-angle-side oil hydraulic chamber provided between the first rotating member and the second rotating member, a cam phase of said one of the outer camshaft and the inner camshaft being changed by switching between oil hydraulic circuits that communicate with the advance-angle-side oil hydraulic chamber and the retard-angle-side oil hydraulic chamber;

a locking device provided to connect another of the outer camshaft and the inner camshaft to the first rotating member with a predetermined cam phase; and a cam holder is provided that rotatably supports the outer camshaft and is provided adjacent to the cam phase changing device, wherein the urging device is provided between the cam phase changing device and the first cam which is a cam that is closest to the cam phase changing device of all cams provided on the outer camshaft and the inner camshaft so that the location of the urging device is close to the cam holder, wherein the urging device is located on the outer circumference of the outer camshaft, wherein the urging device has a first end directly connected to the outer camshaft by a first pin, and a second end directly connected to the inner camshaft by a second pin, and wherein the urging device is located between the first cam and the cam phase changing device in an axial direction of the inner camshaft.

2. The internal combustion engine according to claim 1, wherein the outer camshaft and the inner camshaft are exhaust camshafts to open and close an exhaust valve, wherein the urging device applies the relative rotational force in a direction such that a phase of the first cam matches a phase of the second cam, and wherein the locking device connects the another of the outer camshaft and the inner camshaft to the first rotating member at a maximum retard angle position.

3. The internal combustion engine according to claim 1, wherein the second rotating member is rotatable integrally with the inner camshaft and rotatable relative to the outer camshaft.

4. The internal combustion engine according to claim 3, wherein the locking device is provided to connect the outer camshaft to the first rotating member with the predetermined cam phase.

5. The internal combustion engine according to claim 4, wherein the locking device includes a lock member supported by the first rotating member to be slidable relative to the first rotating member along a rotational axis of the first rotating member, wherein the outer camshaft includes a lock hole, and wherein the lock member is inserted into the lock hole when the locking device connects the outer camshaft to the first rotating member.

6. The internal combustion engine according to claim 4, wherein the locking device is provided to connect the second rotating member to the first rotating member.

7. The internal combustion engine according to claim 6, wherein the locking device includes a lock member supported by the second rotating member to be slidable relative to the second rotating member along a rotational axis of the second rotating member, wherein the first rotating member includes a lock hole, and wherein the lock member is inserted into the lock hole when the locking device connects the second rotating member to the first rotating member.

8. The internal combustion engine according to claim 1, wherein the outer camshaft and the inner camshaft are rotatable about a rotational axis, and wherein the inner camshaft is rotatable relative to the outer camshaft about the rotational axis within a predetermined angle range.

9. The internal combustion engine according to claim 8, wherein the first cam includes a first portion and a second portion, the first and second portions being provided on the outer circumference of the outer camshaft to open and close the valve, the second portion being spaced apart from the first portion along the rotational axis, and wherein the second cam is provided between the first and second portions to be rotatable relative to the first and second portions about the rotational axis within the predetermined angle range.

10. The internal combustion engine according to claim 1, wherein the first cam is a closest cam on the outer camshaft to the cam phase changing device in the axial direction.

11. The internal combustion engine according to claim 1, wherein the first pin extends from the outer camshaft in a radial direction of the outer camshaft, and wherein the second pin extends from the inner camshaft in a radial direction of the inner camshaft.

12. The internal combustion engine according to claim 11, wherein the second pin extends in the radial direction of the inner camshaft through an opening in the outer camshaft.

13. The internal combustion engine according to claim 12, wherein the first pin and the second pin are latch pins, and wherein the first end and the second end of the urging device are hooked on the latch pins, respectively.

14. The internal combustion engine according to claim 1, wherein the first pin and the second pin are latch pins, and wherein the first end and the second end of the urging device are hooked on the latch pins, respectively.

15. The internal combustion engine according to claim 8, wherein the second cam is fixed to the inner camshaft via a fixing pin, the fixing pin extending in a radial direction of the inner camshaft through an elongated hole in the outer camshaft so as to be rotatable within the predetermined angle range.

16. The internal combustion engine according to claim 9, wherein the second cam is fixed to the inner camshaft via a fixing pin, the fixing pin extending in a radial direction of the inner camshaft through an elongated hole in the outer camshaft so as to be rotatable within the predetermined angle range.

* * * * *